US006675503B2

(12) United States Patent
Liu

(10) Patent No.: US 6,675,503 B2
(45) Date of Patent: Jan. 13, 2004

(54) EASY-TO-WEAR FOOTWEAR

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 49 days.

(21) Appl. No.: 10/137,937

(22) Filed: May 2, 2002

(65) Prior Publication Data

US 2003/0204970 A1 Nov. 6, 2003

(51) Int. Cl.[7] ..... A43C 11/00
(52) U.S. Cl. ..... 36/50.1; 24/712.4; 24/712.9
(58) Field of Search ..... 36/50.1; 24/712, 24/712.4, 712.9, 68 B, 685 K

(56) References Cited

U.S. PATENT DOCUMENTS 3,279,015 A * 10/1966 Henning ..... 24/712.2
4,414,761 A 11/1983 Mahood
5,157,813 A * 10/1992 Carroll ..... 24/68 SK
5,205,055 A * 4/1993 Harrell ..... 36/50.1
5,469,640 A 11/1995 Nichols
6,568,104 B2 * 5/2003 Liu ..... 36/50.1

* cited by examiner

*Primary Examiner*—M. D. Patterson
(74) *Attorney, Agent, or Firm*—Frommer Lawrence & Haug LLP; Matthew K. Ryan

(57) ABSTRACT

A lace tightening assembly on a footwear body includes a base, a spool, a pull string, and a restricting unit. The base is mounted to the footwear body. The spool is mounted rotatably on the base. The pull string has a fixing portion secured to the spool, an intermediate portion connected to the fixing portion and wound on the spool, and a connecting portion connected to the intermediate portion and provided with a ring unit. The restricting unit restricts rotation of the spool relative to the base.

7 Claims, 10 Drawing Sheets

EASY-TO-WEAR FOOTWEAR

BACKGROUND OF THE INVENTION

1. Field of the Invention

The invention relates to a footwear, more particularly to a footwear which is easy to wear and remove.

2. Description of the Related Art

A conventional footwear usually includes a footwear body with a top opening, and a footwear lace. The footwear body includes a vamp, a tongue, and a pair of eyelet tabs. The tongue has a front portion connected to the vamp, and a rear portion extending to the top opening. The tongue further has an opposite pair of lateral sides that extend from the vamp to the top opening. Each of the eyelet tabs is connected to the vamp, and is disposed adjacent to one of the lateral sides of the tongue. Each of the eyelet tabs is formed with a plurality of eyelets that are aligned with each other in a direction from the vamp to the top opening. The footwear lace has front and rear portions. The front portion of the footwear lace is strung through the eyelets to form a criss-cross pattern on the eyelet tabs. The rear portion of the footwear lace can be tied together so as to tighten the footwear. However, it is time-wasting to tie and untie the footwear lace when wearing and removing the footwear.

U.S. Pat. No. 5,469,640 discloses a quick adjusting footwear lace system for adjusting footwear lace tension in a single movement. Referring to FIGS. 1 and 2, the footwear lace system disclosed in this U.S. patent includes a cinch plate 3 having eyelets 301 which are spaced apart by about the same distance as eyelets 201 formed in the eyelet tabs of the footwear. The footwear lace 1 is strung through the eyelets 301 at the cinch plate 3 along with the eyelets 201 in the eyelet tabs of the footwear. A strap 4, fixably attached at a lower end to the footwear body 2 and loopable at an upper end through a slot in the cinch plate 3, is used to adjustably pull the cinch plate 3 and the footwear lace 1 looped through the eyelets 301 downwardly and thus increase the footwear lace tension so as to tighten the footwear. However, the footwear lace system disclosed in this U.S. patent is merely configured to adjust tension of the footwear lace, and does not facilitate wearing and removal of the footwear.

U.S. Pat. No. 4,414,761 discloses a footwear having an improved closure. Referring to FIGS. 3 and 4, the closure of the footwear 6 disclosed in this U.S. patent includes a first elongate area 601 provided with a plurality of eyelets, a second non-apertured elongate area 602 provided with a male VELCRO™ fastener 702, a footwear lace 5, and a panel 7 provided with a plurality of eyelets corresponding to the eyelets of the first elongate area 601 and a female VELCRO™ fastener 701 on the inner surface of the panel 7. The footwear lace 5 is strung through the eyelets of the first elongate area 601 and the eyelets of the panel 7 to form a criss-cross pattern. The panel 7 can releasably engage the second non-apertured elongate area 602 through the engagement between the male and female fasteners 702, 701.

Although the footwear disclosed in U.S. Pat. No. 4,414,761 facilitates wearing and removal of the footwear, the VELCRO™ fasteners are liable to loosen during use and easily accumulate dirt thereon.

SUMMARY OF THE INVENTION

Therefore, the object of the present invention is to provide a footwear which is provided with a lace tightening assembly that facilitates wearing and removal of the footwear.

The footwear according to this invention includes a footwear body, a lace tightening assembly, and a footwear lace unit.

The footwear body has a top opening, and includes a vamp, and first and second eyelet tabs connected to the vamp. The first eyelet tab is formed with a plurality of eyelets. The second eyelet tab includes a front portion proximate to the vamp, a rear portion proximate to the top opening, and an intermediate eyelet-free portion between the front and rear portions of the second eyelet tab. Each of the front and rear portions of the second eyelet tab is provided with at least one eyelet.

The lace tightening assembly includes: a base mounted to the second eyelet tab at the eyelet-free portion; a spool mounted rotatably on the base; a pull string having a fixing portion secured to the spool, an intermediate portion connected to the fixing portion and wound on the spool, and a connecting portion connected to the intermediate portion and provided with a ring unit; and a restricting unit for restricting rotation of the spool relative to the base.

The footwear lace unit has a first portion and a second portion. The first portion of the footwear lace unit is strung through the eyelets of the first eyelet tab, the eyelets of the second eyelet tab and the ring unit to form a criss-cross pattern on the first and second eyelet tabs. The second portion of the footwear lace unit is disposed proximate to the top opening.

The spool is rotatable relative to the base in a footwear tightening direction, in which the pull string is wound on the spool to increase tension of the footwear lace unit, and a footwear loosening direction opposite to the footwear tightening direction, in which the pull string is unwound from the spool to slacken the footwear lace unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
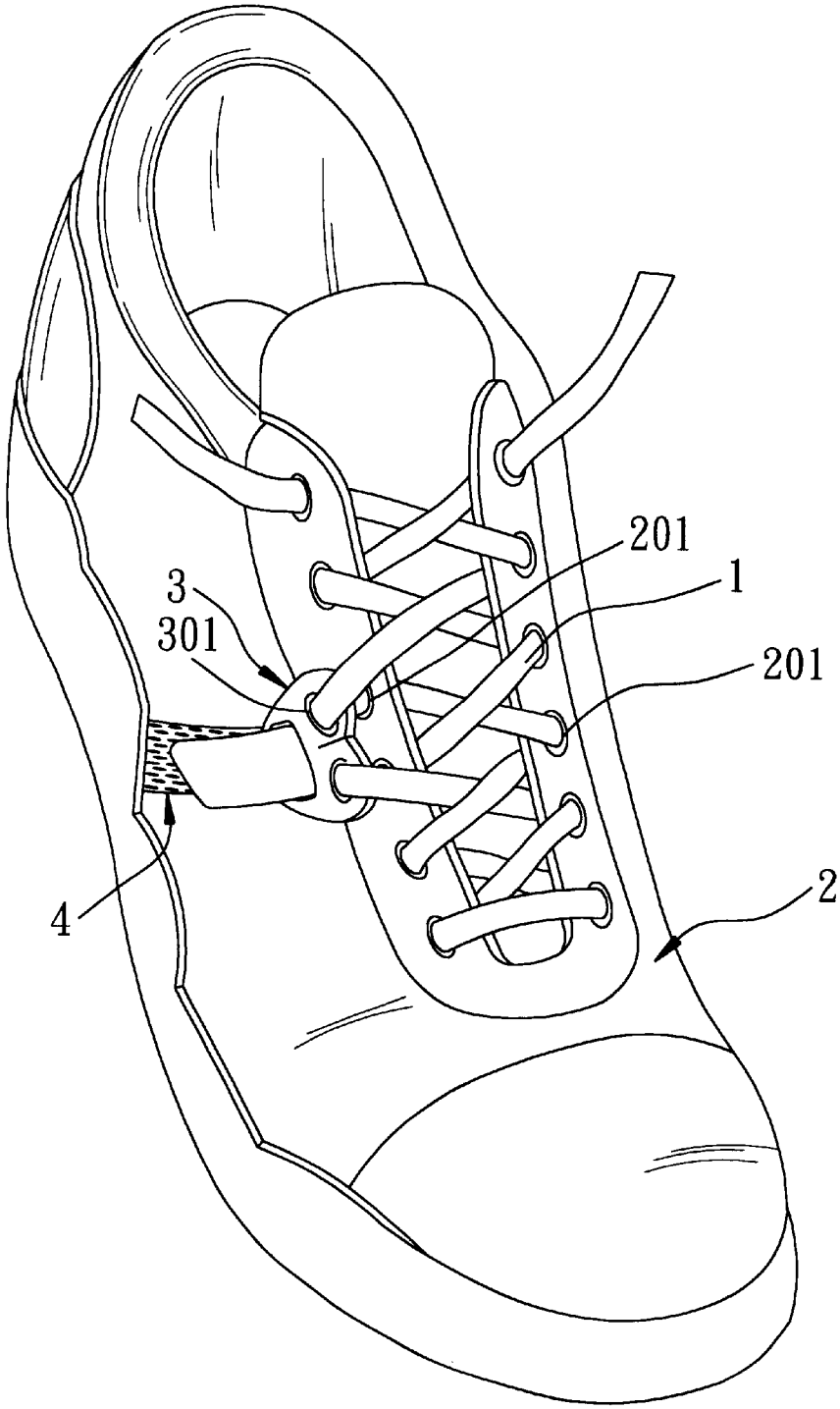
FIG. 1 PRIOR ART
FIG. 1 is a perspective view of a conventional footwear disclosed in U.S. Pat. No. 5,469,640.
Figure 2:
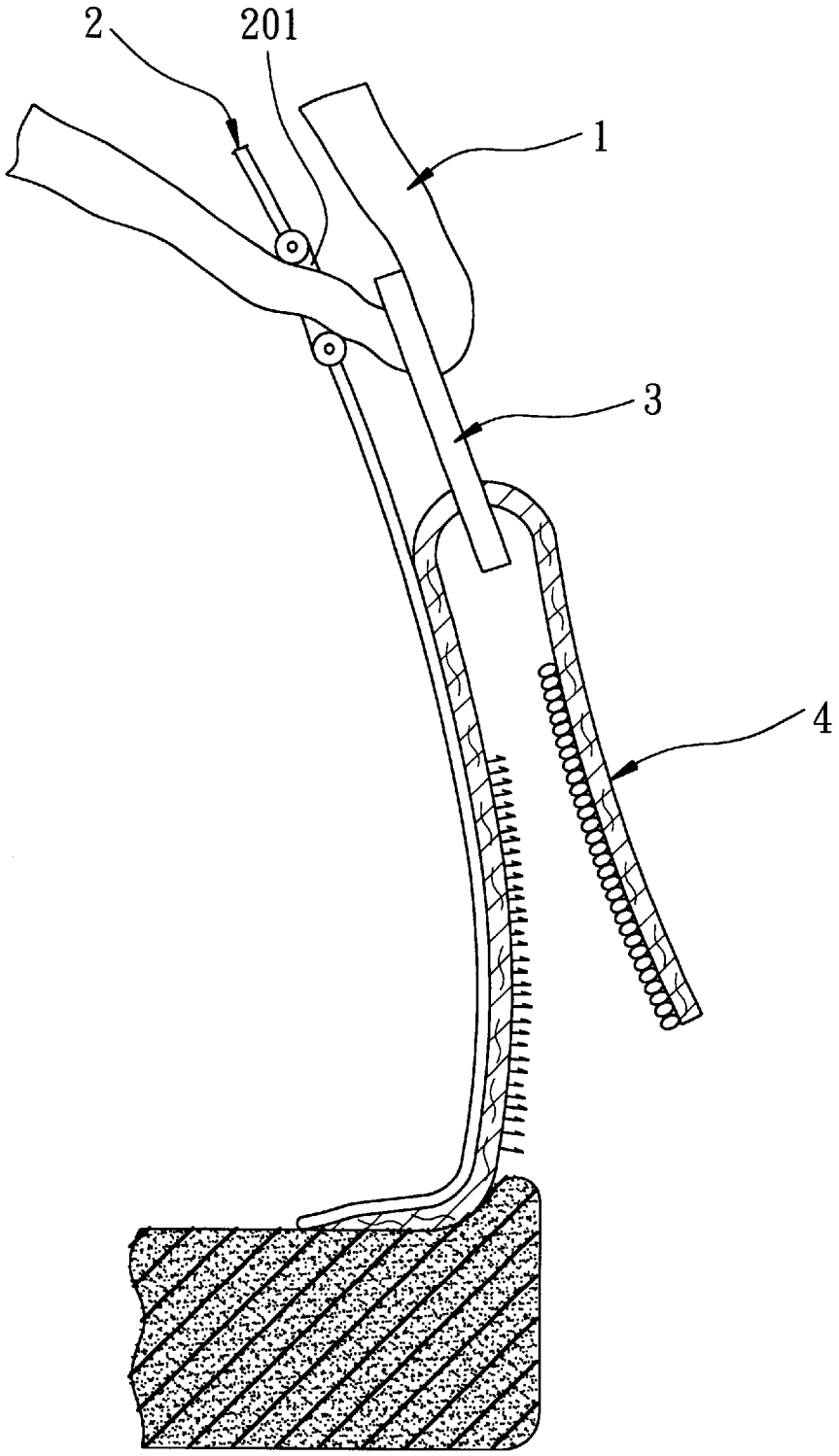
FIG. 2 PRIOR ART
FIG. 2 is a fragmentary sectional view of the footwear of FIG. 1.
Figure 3:
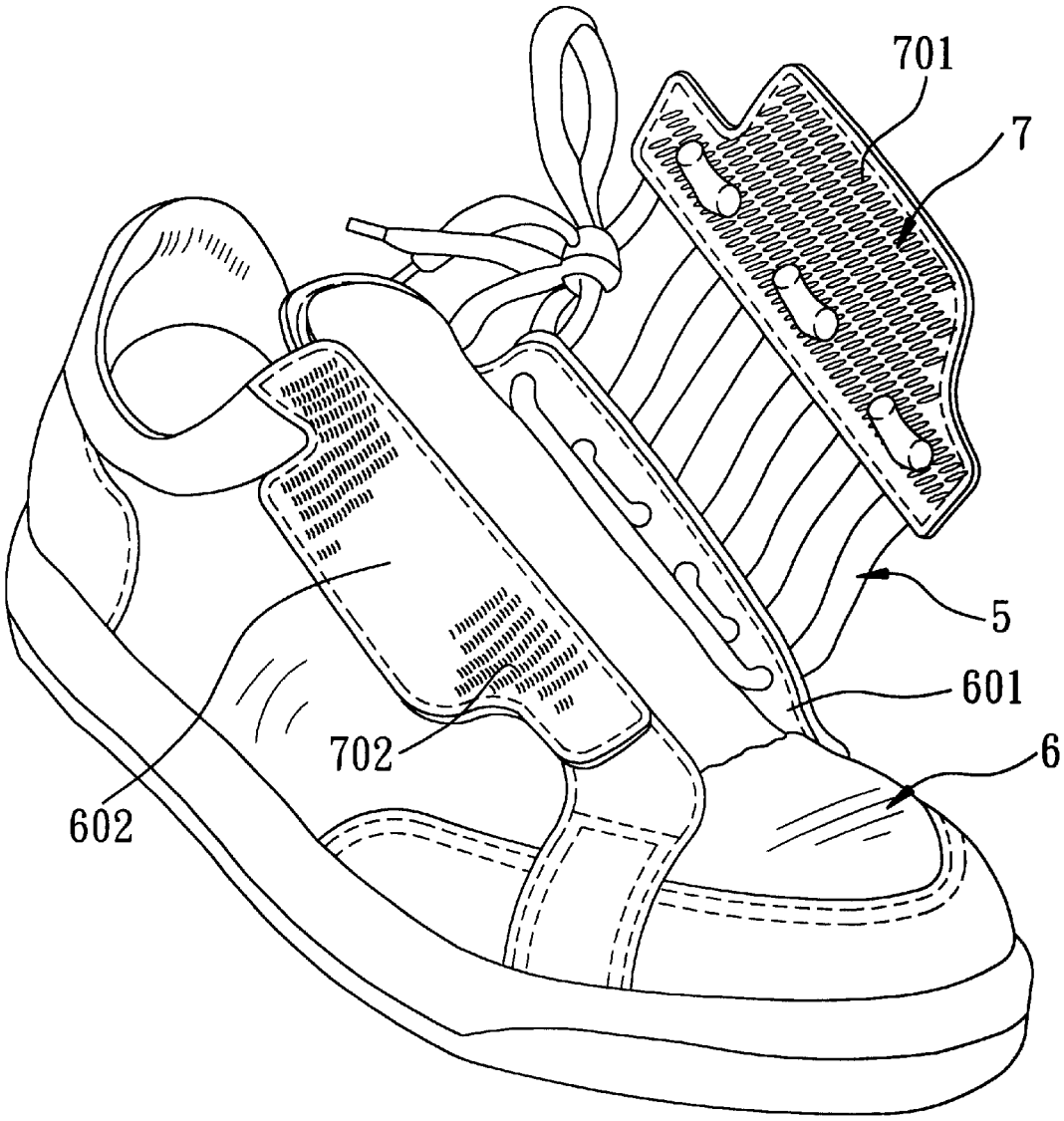
FIG. 3 PRIOR ART
FIG. 3 is a perspective view of another conventional footwear disclosed in U.S. Pat. No. 4,414,761 in an opened state.
Figure 4:
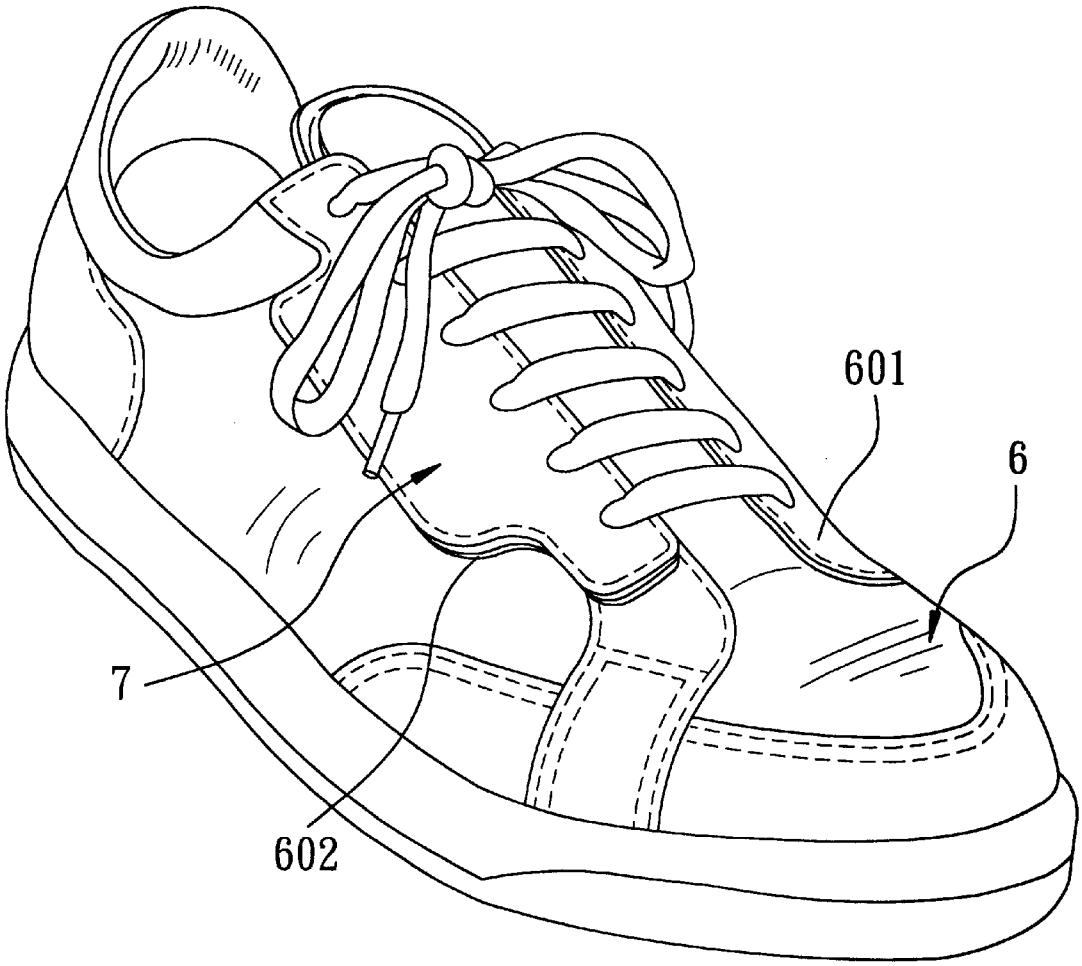
FIG. 4 PRIOR ART
FIG. 4 is a perspective view of the footwear of FIG. 3 in a closed state.
Figure 5:
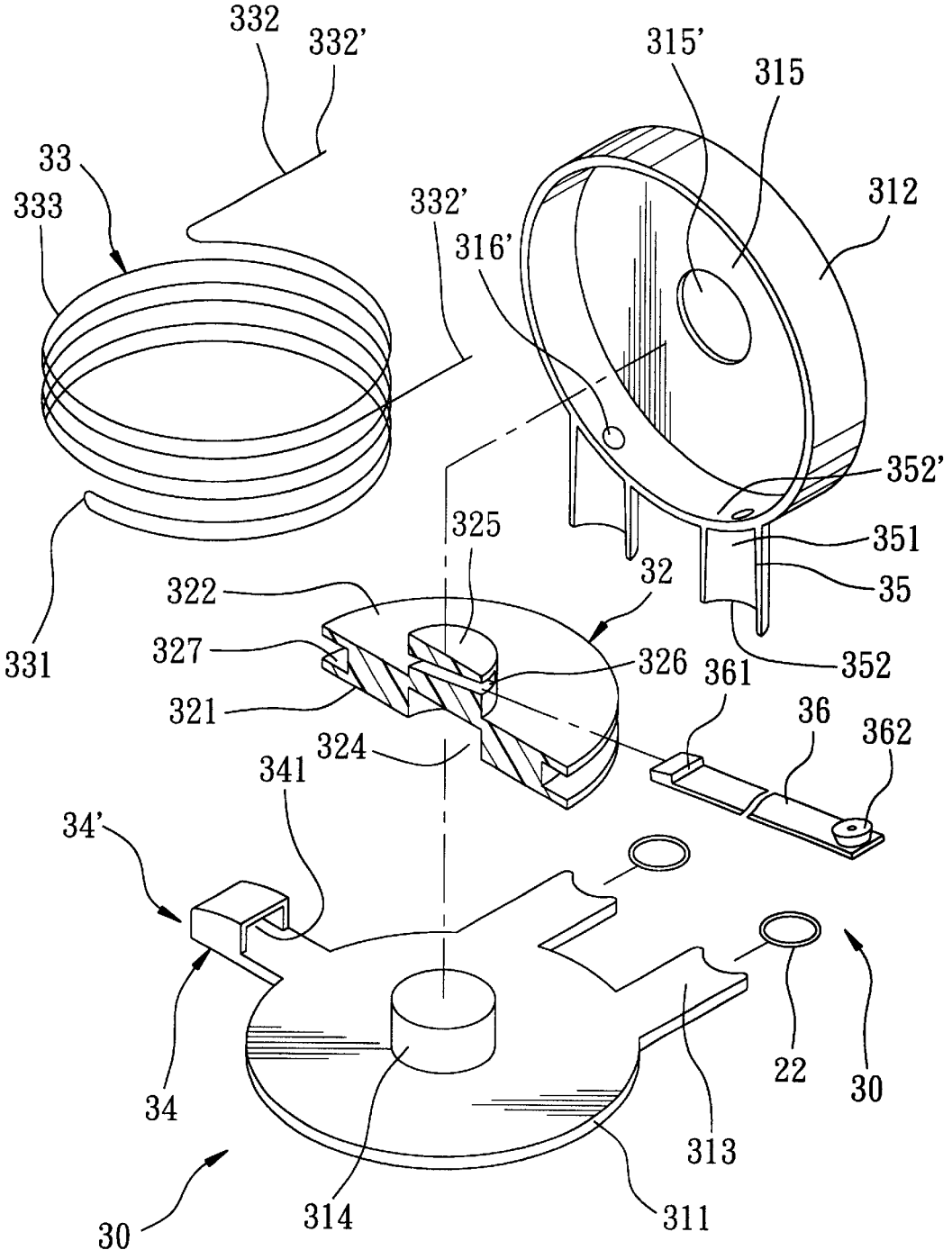
FIG. 5 is an exploded perspective view of the lace tightening assembly of the preferred embodiment of a footwear according to this invention.
Figure 6:
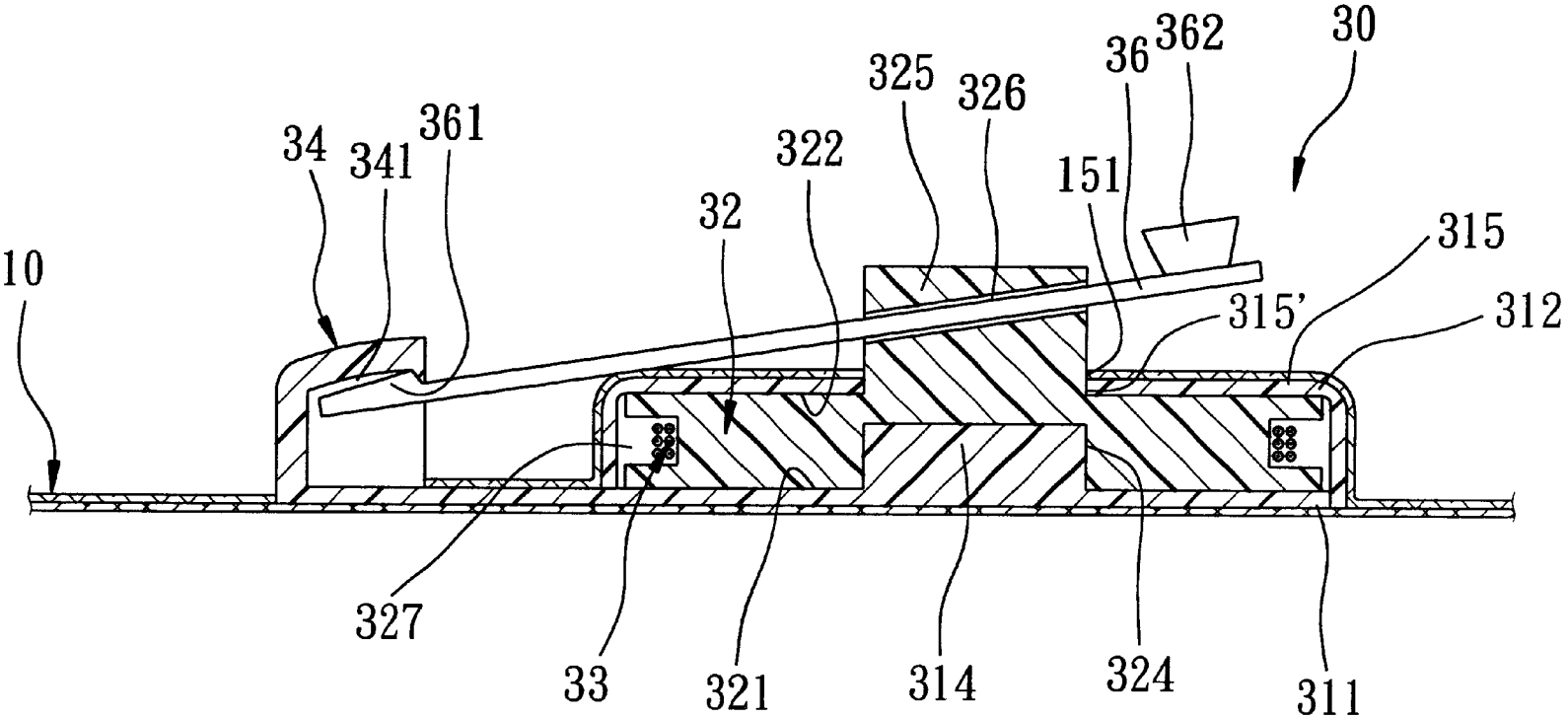
FIG. 6 is a sectional view of the lace tightening assembly of FIG. 5 in a restricting state.
Figure 8:
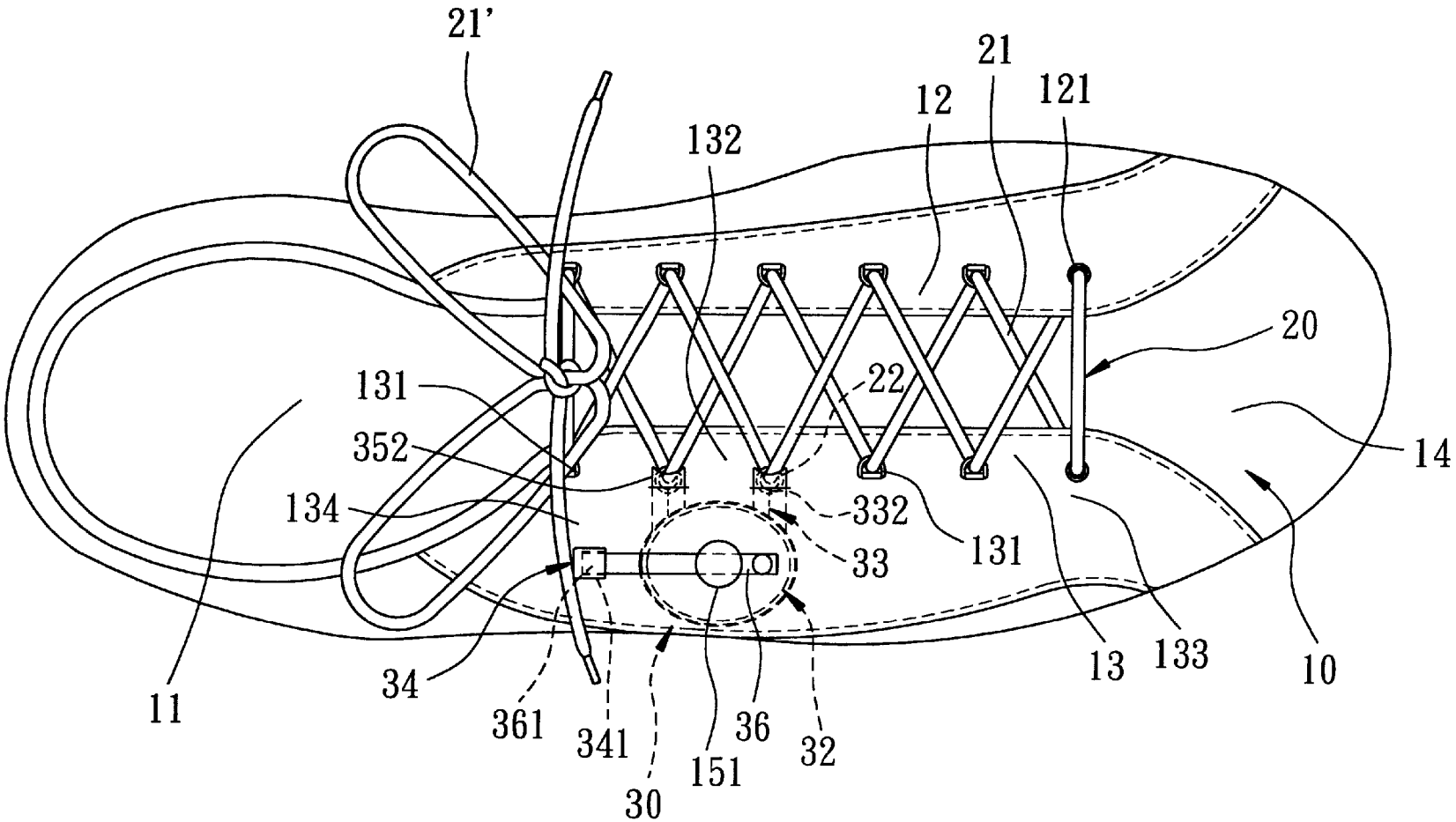
FIG. 8 is a top view of the preferred embodiment of the footwear according to this invention in a footwear tightening state.

Referring to FIGS. 5, 6 and 8, the preferred embodiment of a footwear according to this invention is shown to include a footwear body 10, a lace tightening assembly 30, and a footwear lace unit 20.

The footwear body 10 has a top opening 11, and includes a vamp 14, and first and second eyelet tabs 12, 13 connected to the vamp 14. The first eyelet tab 12 is formed with a plurality of eyelets 121. The second eyelet tab 13 includes a front portion 133 proximate to the vamp 14, a rear portion 134 proximate to the top opening 11, and an intermediate eyelet-free portion 132 between the front and rear portions 133, 134 of the second eyelet tab 13. The front portion 133 of the second eyelet tab 13 is provided with a plurality of eyelets 131. The rear portion 134 of the second eyelet tab 13 is provided with an eyelet 131. The intermediate eyelet-free portion 132 of the second eyelet tab 13 is formed with a blind hole unit 151.

The lace tightening assembly 30 can be mounted on the eyelet-free portion 132 of the second eyelet tab 13, or embedded within the eyelet-free portion 132 of the second eyelet tab 13, as shown in FIG. 6. The lace tightening assembly 30 includes: a base 311 mounted to the second eyelet tab 13 at the eyelet-free portion 132; a spool 32 mounted rotatably on the base 311; a pull string 33 having a fixing portion 331 secured to the spool 32, an intermediate portion 333 connected to the fixing portion 331 and wound on the spool 32, and a connecting portion 332 connected to the intermediate portion 333; and a restricting unit 34' for restricting rotation of the spool 32 relative to the base 311. The connecting portion 332 of the pull string 33 has two string ends 332', each of which is connected to a ring unit 22.

The base 311 is formed with an axle 314 that projects upwardly therefrom. The spool 32 has a bottom side 321 formed with a recess 324 for coupling rotatably with the axle 314 such that the spool 32 is rotatable relative to the base 311 about the axle 314. The spool 32 is further formed with an annular peripheral groove 327 to permit winding of the intermediate portion 333 of the pull string 33 thereon.

Figure 7:
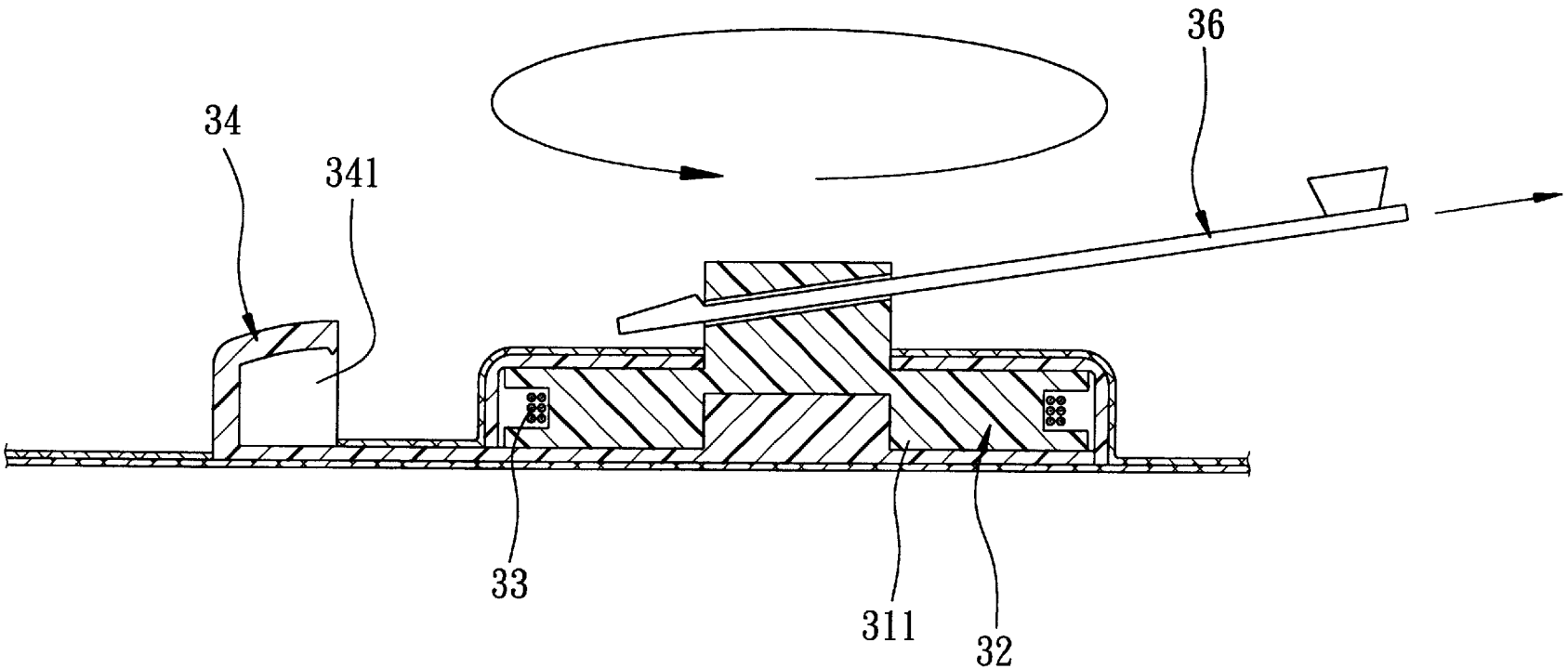
FIG. 7 is a sectional view of the lace tightening assembly of FIG. 5 in a releasing state.

The restricting unit 34' includes a positioning seat 34 disposed on the base 311 adjacent to the spool 32 and formed with a receiving hole 341. As shown in FIG. 5, the positioning seat 34 can be formed integrally with the base 311. The spool 32 is further formed with a stub 325, which projects upwardly therefrom and which has a guiding passage 326 transverse to the axle 314. As shown in FIG. 6, when the lace tightening assembly 30 is embedded within the eyelet-free portion 132 of the second eyelet tab 13, the stub 325 extends above the top surface 322 of the spool 32 through the hole unit 151. The lace tightening assembly 30 further includes a lever 36 to facilitate rotation of the spool 32 relative to the base 311. The lever 36 has an engaging end 361, which can engage the positioning seat 34 so as to restrict rotation of the spool 32 relative to the base 311, and an operating end 362 opposite to the engaging end 361. The lever 36 is slidably coupled to the spool 32 by extending the same through the guiding passage 326 of the stub 325. Thus, the lever 36 is slidable radially relative to the spool 32 between a restricting position, in which the lever 36 extends into the receiving hole 341 and engages the positioning seat 34 so as to restrict rotation of the spool 32 relative to the base 311 as shown in FIG. 6, and a releasing position, in which the lever 36 is pulled out of the receiving hole 341 and disengages the positioning seat 34 to permit rotation of the spool 32 relative to the base 311 as shown in FIG. 7.

The lace tightening assembly 30 further includes a cap 312 mounted on the base 311 to conceal the spool 32 between the cap 312 and the base 311. The cap 312 has a top surface 315 formed with a top opening 315', which permits the stub 325 of the spool 32 to extend therethrough. Moreover, the lace tightening assembly 30 further includes two tubular ring guides 35 disposed on the base 311 and extending toward the first eyelet tab 12. Each of the ring guides 35 has an end wall 352' and an open end 352 that are respectively distal and proximate to the first eyelet tab 12 (see FIG. 8). Each of the end walls 352' is formed with a string hole 316' that permits extension of one of the string ends 332' of the connecting portion 332 of the pull string 33 therein such that the ring units 22 are movably and respectively disposed in the ring guides 35. In the preferred embodiment, each of the ring guides 35 is composed of an upper guiding portion 351 integrally formed with the cap 312, and a lower guiding portion 313 integrally formed with the base 311, as best shown in FIG. 5.

Referring to FIG. 8, the footwear lace unit 20 has a first portion 21 and a second portion 21'. The first portion 21 of the footwear lace unit 20 is strung through the eyelets 121 of the first eyelet tab 12, the eyelets 131 of the second eyelet tab 13 and the ring units 22 to form a criss-cross pattern on the first and second eyelet tabs 12, 13. The second portion 21' of the footwear lace unit 20 is disposed proximate to the top opening 11, and can be tied to form a double-bow configuration.

Figure 9:
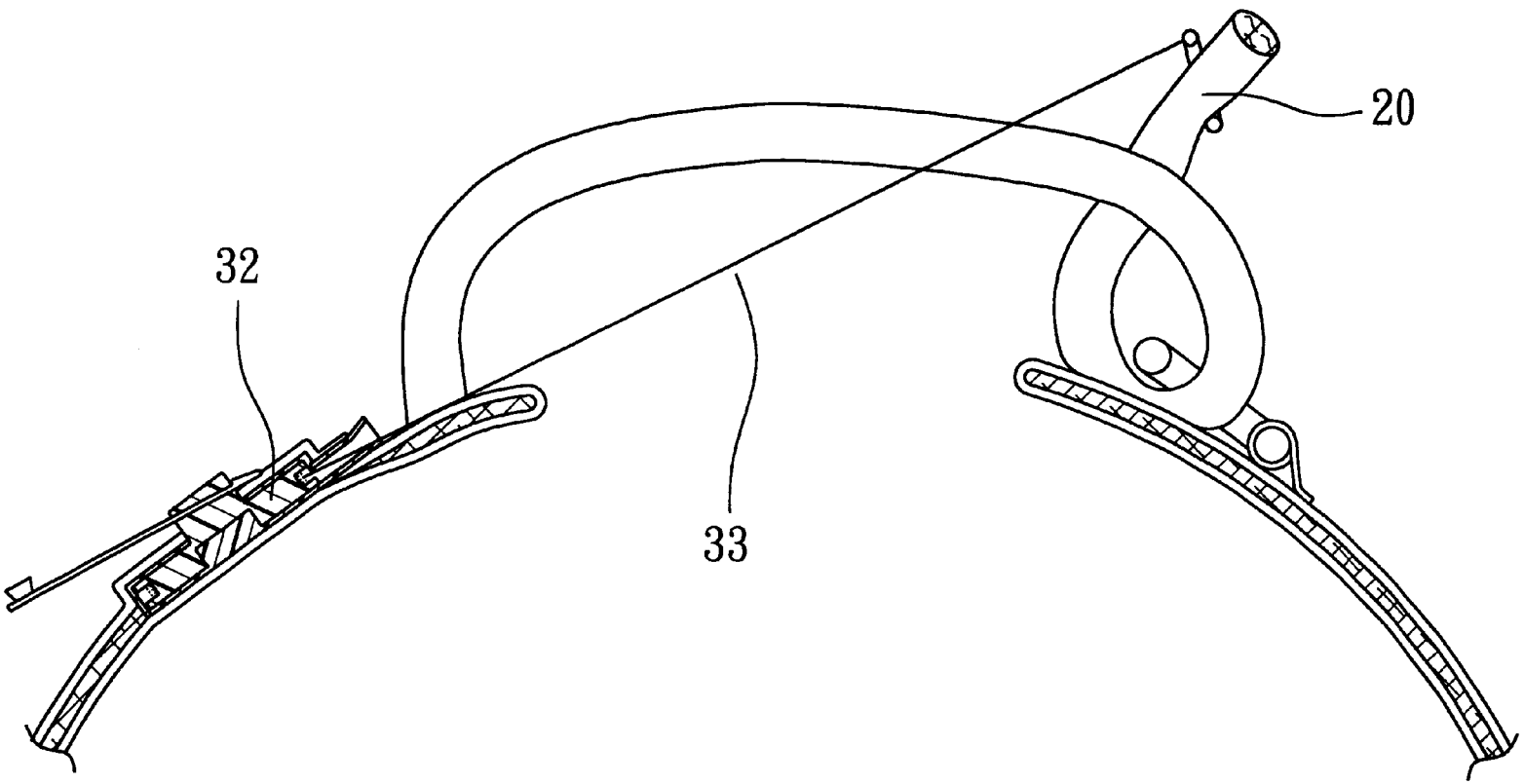
FIG. 9 is a fragmentary sectional view of the preferred embodiment, showing the lace tightening assembly in a state that facilitates removal of the footwear.
Figure 10:
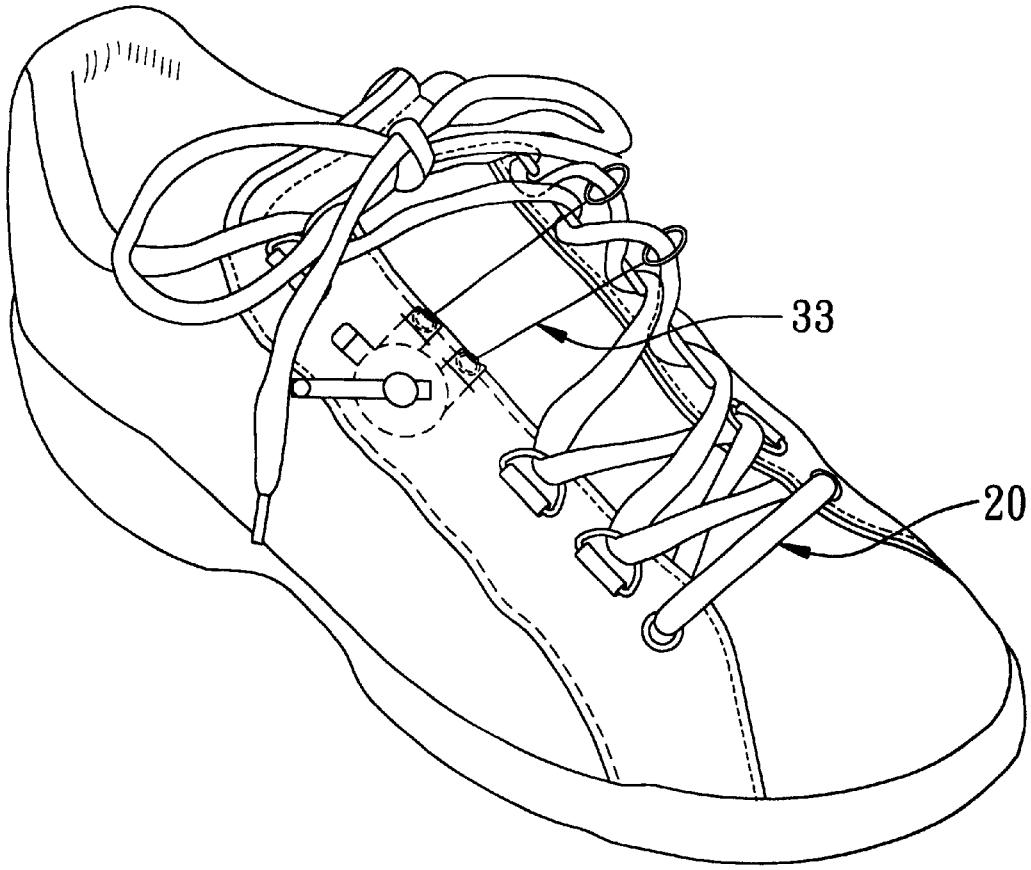
FIG. 10 is a perspective view of the preferred embodiment according to this invention in a loosened state.

The spool 32 is rotatable relative to the base 311 via the lever 36 in a footwear tightening direction, in which the pull string 33 is wound on the spool 32 to increase tension of the footwear lace unit 20 so as to tighten the footwear after the lever 36 extends into the receiving hole 341 and engages the positioning seat 34, as shown in FIGS. 6 and 8, and a footwear loosening direction opposite to the footwear tightening direction, as shown in FIGS. 9 and 10, in which the pull string 33 is unwound from the spool 32 to slacken the footwear lace unit 20 so as to loosen and facilitate removal of the footwear.

In view of the aforesaid, the footwear according to this invention can be tightened and taken off quickly and easily.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A footwear, comprising:

a footwear body having a top opening, said footwear body including a vamp, and first and second eyelet tabs connected to said vamp, said first eyelet tab being formed with a plurality of eyelets, said second eyelet tab including a front portion proximate to said vamp, a rear portion proximate to said top opening, and an intermediate eyelet-free portion between said front and rear portions of said second eyelet tab, each of said front and rear portions of said second eyelet tab being provided with at least one eyelet;

a lace tightening assembly including a base mounted to said second eyelet tab at said eyelet-free portion, a spool mounted rotatably on said base, a pull string having a fixing portion secured to said spool, an intermediate portion connected to said fixing portion and wound on said spool, and a connecting portion connected to said intermediate portion and provided with a ring unit, and a restricting unit for restricting rotation of said spool relative to said base; and a footwear lace unit having a first portion and a second portion, said first portion of said footwear lace unit being strung through said eyelets of said first eyelet tab, said eyelets of said second eyelet tab and said ring unit to form a criss-cross pattern on said first and second eyelet tabs, said second portion of said footwear lace unit being disposed proximate to said top opening;

said spool being rotatable relative to said base in a footwear tightening direction, in which said pull string is wound on said spool to increase tension of said footwear lace unit, and a footwear loosening direction opposite to the footwear tightening direction, in which said pull string is unwound from said spool to slacken said footwear lace unit.

2. The footwear as claimed in claim 1, wherein said base is formed with an axle that projects upwardly therefrom, and said spool has a bottom side formed with a recess for coupling rotatably with said axle such that said spool is rotatable relative to said base about said axle.

3. The footwear as claimed in claim 1, wherein said lace tightening assembly further includes a lever coupled to said spool to facilitate rotation of said spool relative to said base.

4. The footwear as claimed in claim 3, wherein said restricting unit includes a positioning seat disposed on said base adjacent to said spool and formed with a receiving hole, said lever being slidably coupled to said spool and being slidable radially relative to said spool between a restricting position, in which said lever extends into said receiving hole and engages said positioning seat to restrict rotation of said spool relative to said base, and a releasing position, in which said lever is pulled out of said receiving hole and disengages said positioning seat to permit rotation of said spool relative to said base.

5. The footwear as claimed in claim 4, wherein said positioning seat is formed integrally with said base.

6. The footwear as claimed in claim 1, wherein said lace tightening assembly further includes a cap mounted on said base to conceal said spool between said cap and said base.

7. The footwear as claimed in claim 1, wherein said lace tightening assembly further includes a tubular ring guide disposed on said base and extending toward said first eyelet tab, said ring guide having an end wall and an open end that are respectively distal and proximate to said first eyelet tab, said end wall being formed with a string hole that permits extension of said connecting portion of said pull string therein such that said ring unit is movably disposed in said ring guide.

* * * * *